US007614103B2

(12) United States Patent
Beaudry et al.

(10) Patent No.: US 7,614,103 B2
(45) Date of Patent: Nov. 10, 2009

(54) STRETCHER WITH BRAKE MECHANISM

(75) Inventors: Benoit Beaudry, Joliette (CA); Hugo Bastien, St-Jerome (CA); Francois Bergeron, La Tuque (CA); Jean-Sébastien Gosselin, St-Rene-de-Matane (CA); Etienne Poulin, Saint-Georges (CA); Vincent Deschamps-Sonsino, Lantier (CA); Noemie Seguin-Tremblay, Sherbrooke (CA)

(73) Assignee: Societe de Commercialisation des Produits de la Recherche Appliquee - Socpra Sciences et Genie S.E.C., Sherbrooke (CA)

( * ) Notice: Subject to any disclaimer, the term of this patent is extended or adjusted under 35 U.S.C. 154(b) by 0 days.

(21) Appl. No.: 11/951,840

(22) Filed: Dec. 6, 2007

(65) Prior Publication Data

US 2008/0134436 A1 Jun. 12, 2008

Related U.S. Application Data

(60) Provisional application No. 60/868,785, filed on Dec. 6, 2006.

(30) Foreign Application Priority Data

Dec. 6, 2006 (CA) ..... 2571674

(51) Int. Cl.
*A61G 1/013* (2006.01)
*A61G 1/04* (2006.01)
*A61G 1/044* (2006.01)

(52) U.S. Cl. ..... 5/628; 5/627; 5/625; 5/81.1 R; 5/925

(58) Field of Classification Search ..... 5/628, 5/627, 626, 625, 81.1 R, 925; 280/604, 605
See application file for complete search history.

(56) References Cited

U.S. PATENT DOCUMENTS 2,175,748 A * 10/1939 Dunn ..... 5/628
5,179,746 A * 1/1993 Rogers ..... 5/625
5,189,746 A 3/1993 Horie
5,249,321 A 10/1993 Graf (Continued)

FOREIGN PATENT DOCUMENTS

EP 0505516 9/1992

(Continued)

*Primary Examiner*—Alexander Grosz
(74) *Attorney, Agent, or Firm*—Osler, Hoskin & Harcourt LLP

(57) ABSTRACT

The present invention provides a stretcher having a brake mechanism that can be selectively activated to influence the movement of the stretcher supported by an inclined surface. The brake mechanism of the stretcher progressively increases the amount of friction between the stretcher and the surface of which the stretcher is supported to reduce or stop movements of the stretcher. The stretcher further includes a pulling member influencing the position or the activation of the brake mechanism on the stretcher and high friction means associated with the bottom side of the stretcher. The present invention also provides a size reduction mechanism requesting limited storage space for the stretcher when not in use and a foot restraint to secure the feet of the patient on the stretcher and offer additional volume to carry additional material with the patient. A method for braking a stretcher on an inclined plane is also disclosed.

16 Claims, 19 Drawing Sheets

U.S. PATENT DOCUMENTS

| | | | | |
|---|---|---|---|---|
| 5,527,051 | A * | 6/1996 | Plaza | 280/32.6 |
| 5,539,945 | A * | 7/1996 | Rosenberg et al. | 5/626 |
| 6,053,534 | A | 4/2000 | Timmerman | |
| 6,061,853 | A | 5/2000 | Laaksonen et al. | |
| 6,604,747 | B2 | 8/2003 | Moore | |
| 6,845,533 | B1 * | 1/2005 | Tulette | 5/626 |
| 2005/0172406 | A1 | 8/2005 | Post | |

FOREIGN PATENT DOCUMENTS

| | | |
|---|---|---|
| WO | WO9203115 | 3/1992 |
| WO | WO9730673 | 8/1997 |
| WO | WO2004026210 | 4/2004 |

* cited by examiner

STRETCHER WITH BRAKE MECHANISM

CROSS REFERENCE

The present application claims priority to U.S. provisional patent application Ser. No. 60/868,785 filed Dec. 6, 2006, the entirety of which is incorporated herein by reference.

FIELD OF THE INVENTION

The present invention relates to a stretcher for moving a person with reduced physical capabilities, and in particular to a stretcher having a brake mechanism to slow down or stop movement of the stretcher when the stretcher is supported by an inclined surface.

BACKGROUND OF THE INVENTION

Hospitals and long-term care facilities must have an evacuation plan in case of emergency. They need to efficiently evacuate the patients very rapidly. This represents a major challenge because most patients have diminished physical capability and cannot evacuate the building on their own. Some patients need to be transported out of the building by other people. This is normally done using a stretcher to carry the patient. The patient is secured to the stretcher before moving the stretcher outside the building using emergency exits.

Elevators should not normally be used during emergency evacuation. This is to prevent the case someone from getting stuck inside the elevator in case of a mechanical failure or power outage. Patients must therefore evacuate using the safety staircases. This is particularly difficult in building having several floors. Patients having a condition requiring the use of a stretcher must also be transported out of the building using the staircases. Conventionally, stretchers can be slid on the stairs to increase the evacuation speed and reduce the number of people required to carry each stretcher. This requires the help of at least one additional person to control the movement of the stretcher on the stairs.

Furthermore, a stretcher in a staircase may easily become cumbersome and may prevent other people from using the stairs during the evacuation process. Conversely, a stretcher that slides directly on the stairs in a staircase might become difficult to control during emergency evacuation. The stretcher must be restrained by another person who helps to prevent it from sliding down the stairs. If the stretcher goes down the stairs too quickly the patient may get an uncomfortable ride.

The patient should be safely secured to the stretcher even if the stretcher is inclined during passage in staircases. Other devices (such as a number of straps) are needed to secure and ensure proper protection of the patient on the stretcher. The patient's head might also need to be safely secured to the stretcher in the case of cervical injuries thus preventing further deterioration of the condition of the patient.

Emergency evacuation stretchers are rarely used. They will spend most of their time in a patient's room in storage and should take a limited amount of space. However, since a stretcher needs to be assembled in a short period of time, the time to assemble the stretcher and the complexity of the assembly should be limited to a minimum.

Conventional stretchers, while adequate for their intended purposes, are not optimal.

STATEMENT OF THE INVENTION

In one aspect, the present invention provides a stretcher having a brake mechanism that can be selectively activated to influence the movement of the stretcher supported by an inclined surface via changing the friction force between the stretcher and the surface.

In another aspect, the present invention provides a brake mechanism on a stretcher that progressively increases the amount of friction between the stretcher and the surface on which the stretcher is supported, to reduce or stop movement of the stretcher.

In one other aspect, the present invention provides a stretcher having a pulling member influencing the position or the activation of the brake mechanism on the stretcher. When a person pulls on the pulling member less friction is provided, conversely, when there is less tension on the pulling member more friction is provided to provide more stability of the stretcher, particularly on an inclined surface. The angle between the pulling member and the stretcher also has an effect on the engagement or disengagement of the brake mechanism on the stretcher. Under normal conditions the brake mechanism is disengaged when the pulling member is at a certain angle with the stretcher (within a range) and engages if the pulling member is on either side of the predetermined angle.

Another aspect of the present invention provides a stretcher having a brake mechanism adapted to engage stairs and progressively move along the bottom side of the stretcher to progressively increase the amount of friction between the stretcher and the stairs.

In one aspect, as embodied and broadly described herein, the present invention provides a high friction means associated with the bottom side of the stretcher that provides a level of friction that is substantially equivalent and opposed to the force generated by gravity on the stretcher, when the stretcher is supported on stairs in a staircase.

In one other aspect of an embodiment described therein, the present invention provides a size reduction mechanism requiring limited storage space for the stretcher, when the stretcher is not in use in the patient room or in a storage room. The size reduction mechanism allows the stretcher to fold over onto itself and easily be unfolded without requiring any tools.

Another aspect of embodiments described herein provides a foot restraint to secure the feet of the patient on the stretcher and may offer additional volume to carry additional material with the patient.

A still further aspect of the present invention is to provide a stretcher with a braking system that is durable, simple in construction and economical to manufacture.

Embodiments of the present invention each have at least one of the above-mentioned objects and/or aspects, but do not necessarily have all of them.

Additional and/or alternative features, aspects, and advantages of the embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF PREFERRED EMBODIMENTS

Figure 1:
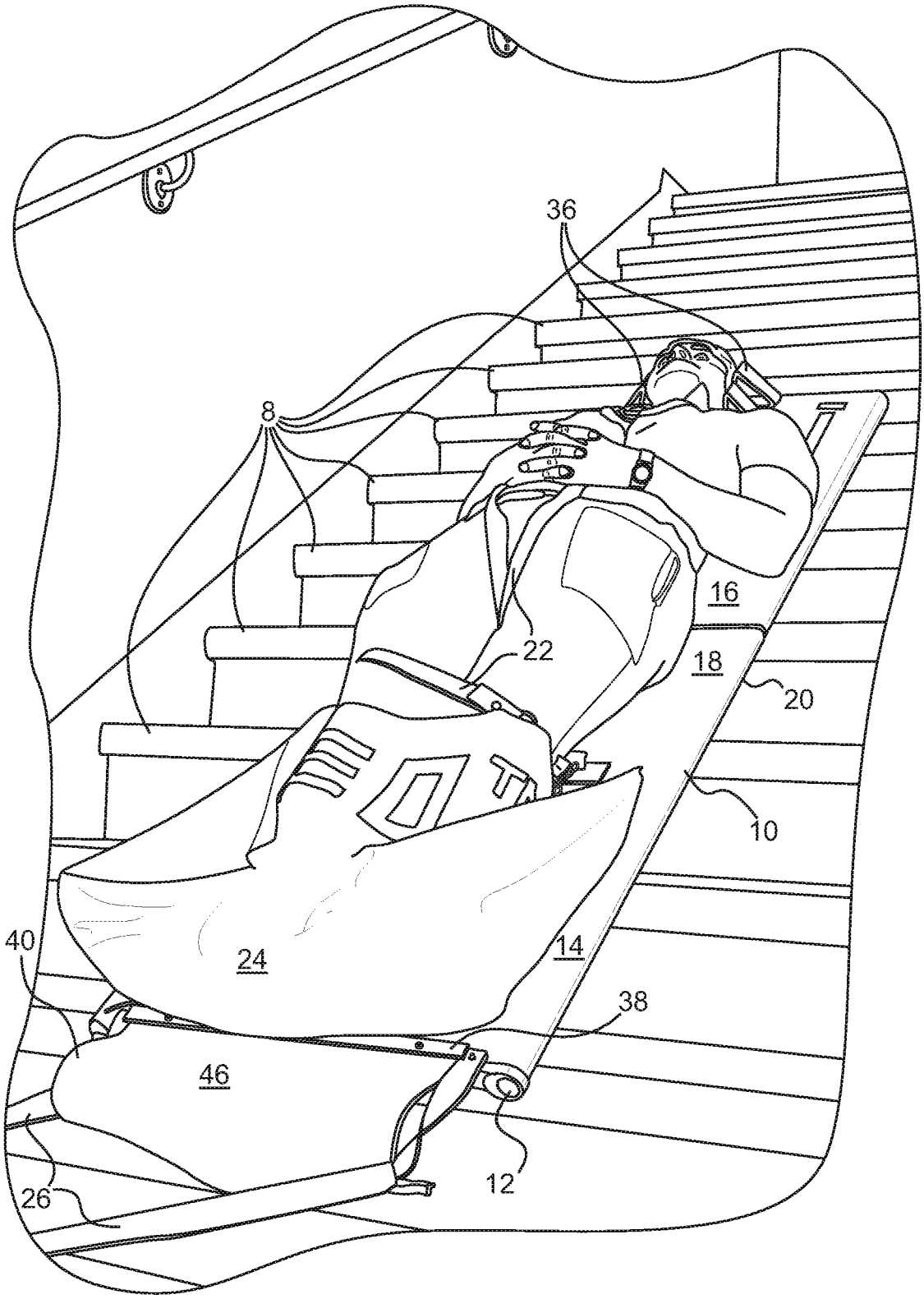
FIG. 1 depicts a stretcher in a staircase.

Referring to FIG. 1, there is illustrated a stretcher 10 accommodating a patient and disposed over stairs 8 in a staircase. The stretcher 10 has a top side 18 adapted to accommodate a person and a bottom side 20, opposite to the top side 18, adapted to contact a ground. The patient is secured on the top side 18 of the stretcher 10 with various body restraints 22, head restraints 36 and feet restraint 24. In a preferred embodiment, the body restraints 22 and head restraints 36 are respectively made of belt material and aluminium, but could also be any other suitable material such as plastic material. The feet restraint 24 prevents the patient significantly from moving on the stretcher 10 when the stretcher 10 is at an angle in a staircase. Preferably, the feet restraint 24 is made of textile material and is larger than the actual volume required to receive the feet of the patient. Because of its larger size, the feet restraint 24 allows room for inserting the patient's feet and also provides additional cargo volume to carry personal belongings with the patient, for example.

Still referring to FIG. 1, a brake mechanism 40 is affixed to the front portion 14 of the stretcher 10. The front portion 14 accommodates the feet restraint 24 and comes first down in a staircase. As best seen on FIGS. 7 through 13, the brake mechanism 40 includes a friction portion 46, in this example, having a semi-cylindrical shape defining a support edge portion 38 connected to the stretcher 10 and an attack edge portion 52. Preferably, the friction portion 46 is made of rubber material. The shape of the friction portion 46 and the material type of the friction portion 46, allows the attack edge 52 to move down, touch the stairs 8, and begin to move the friction portion 46 between the stairs 8 and the stretcher 10 when the stretcher 10 is pulled using pull member 26 or when the stretcher moves downward with gravity.

Figure 11:
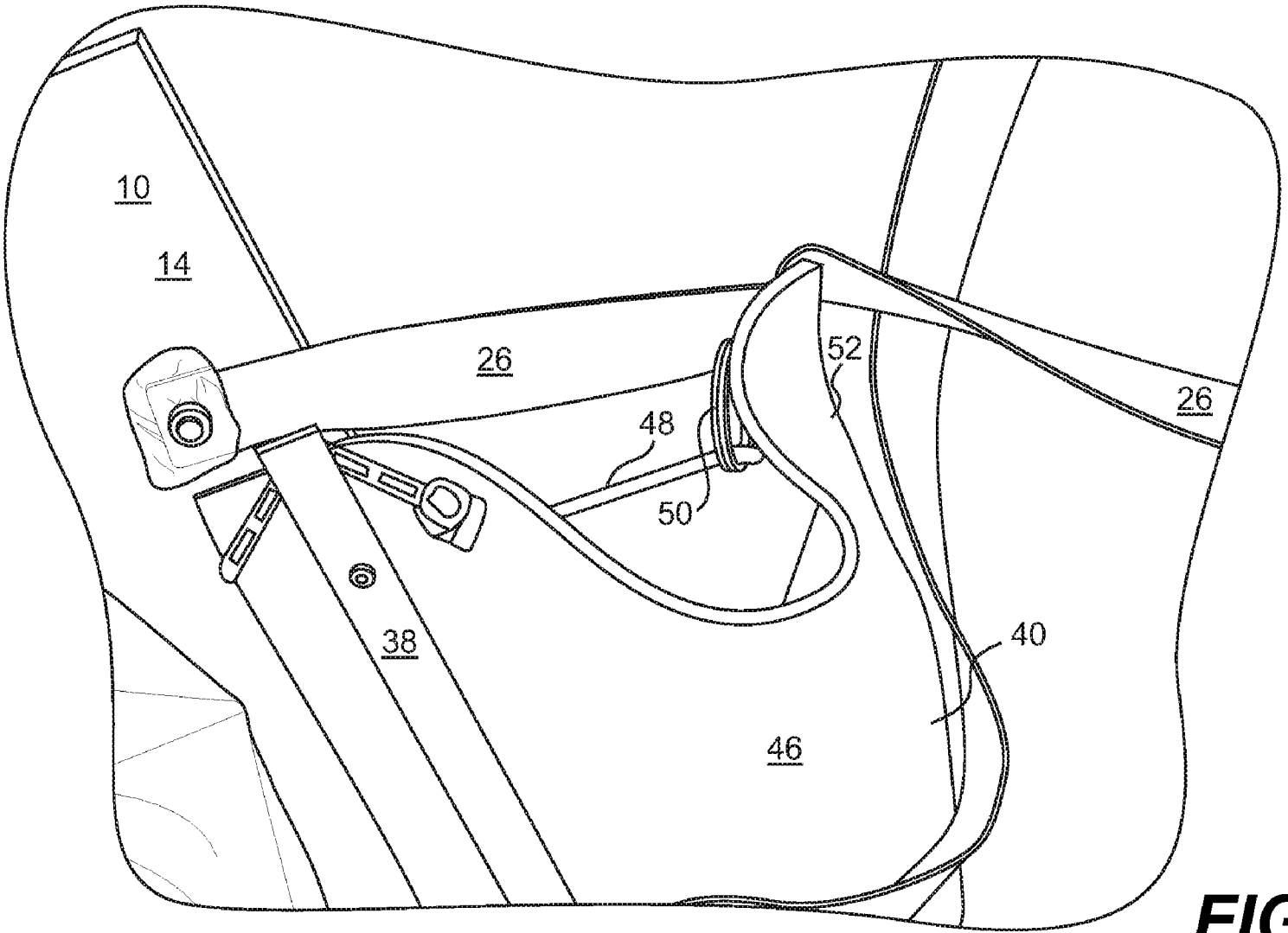
Figure 12:
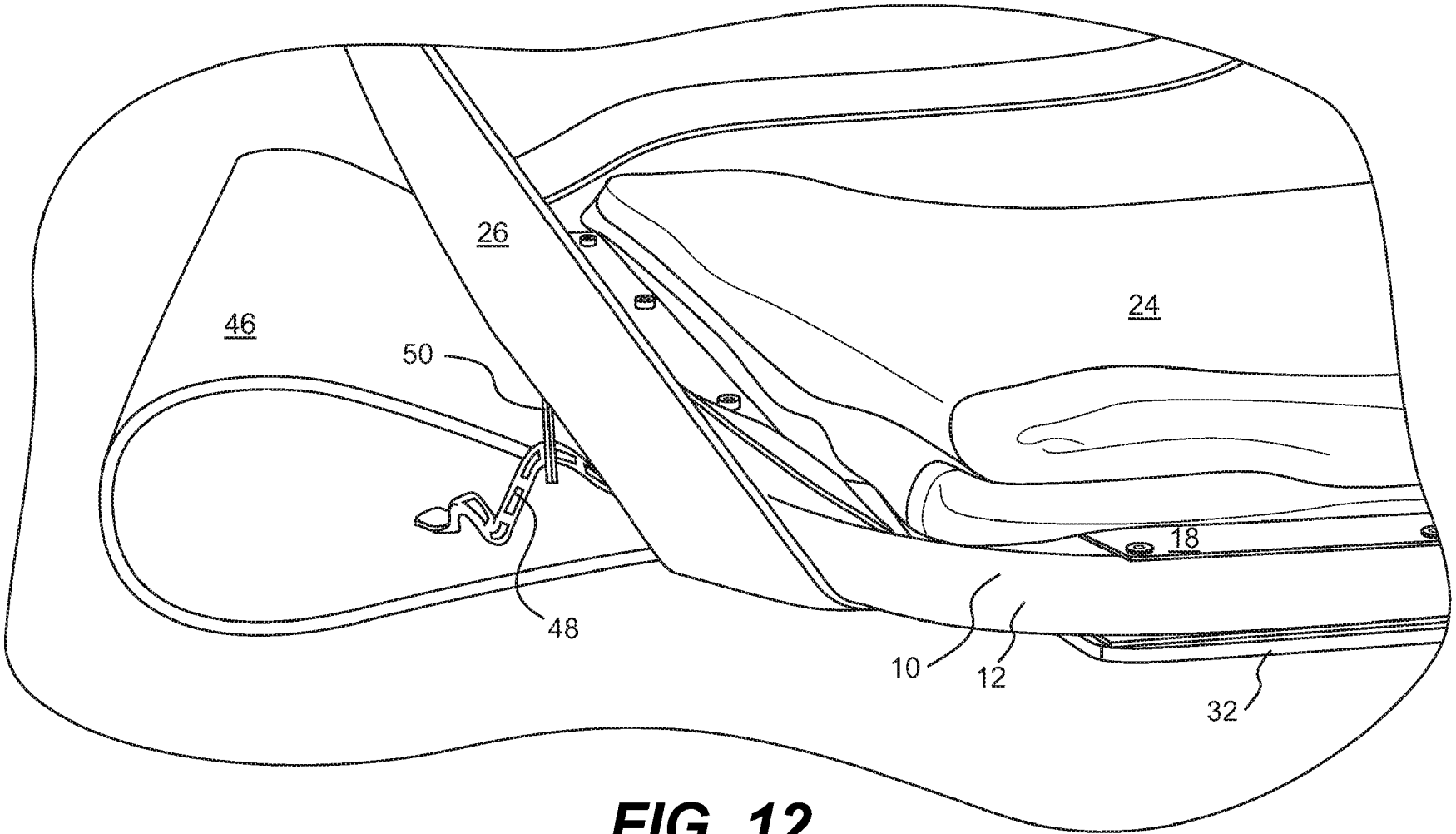
Figure 13:
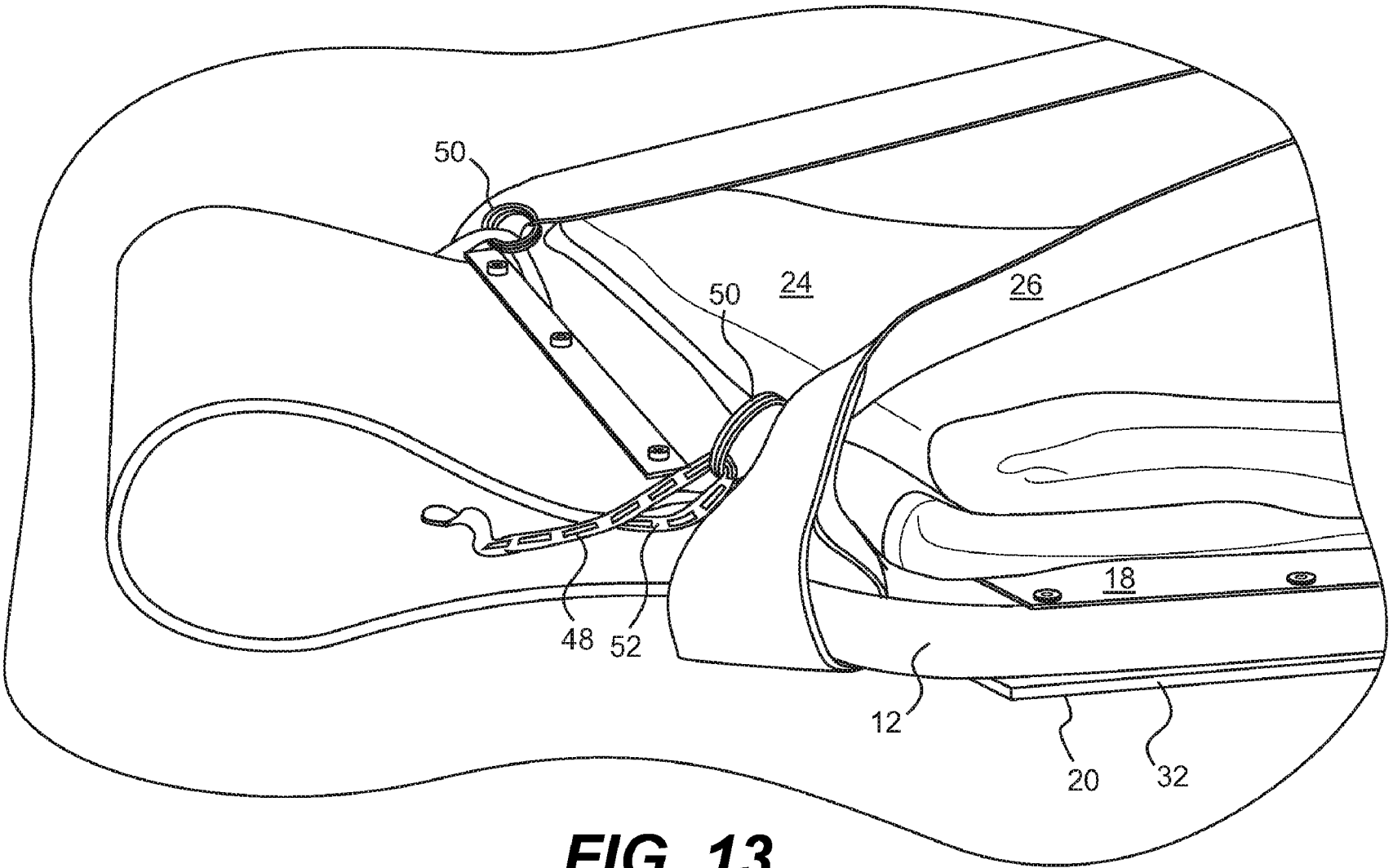
Figure 14:
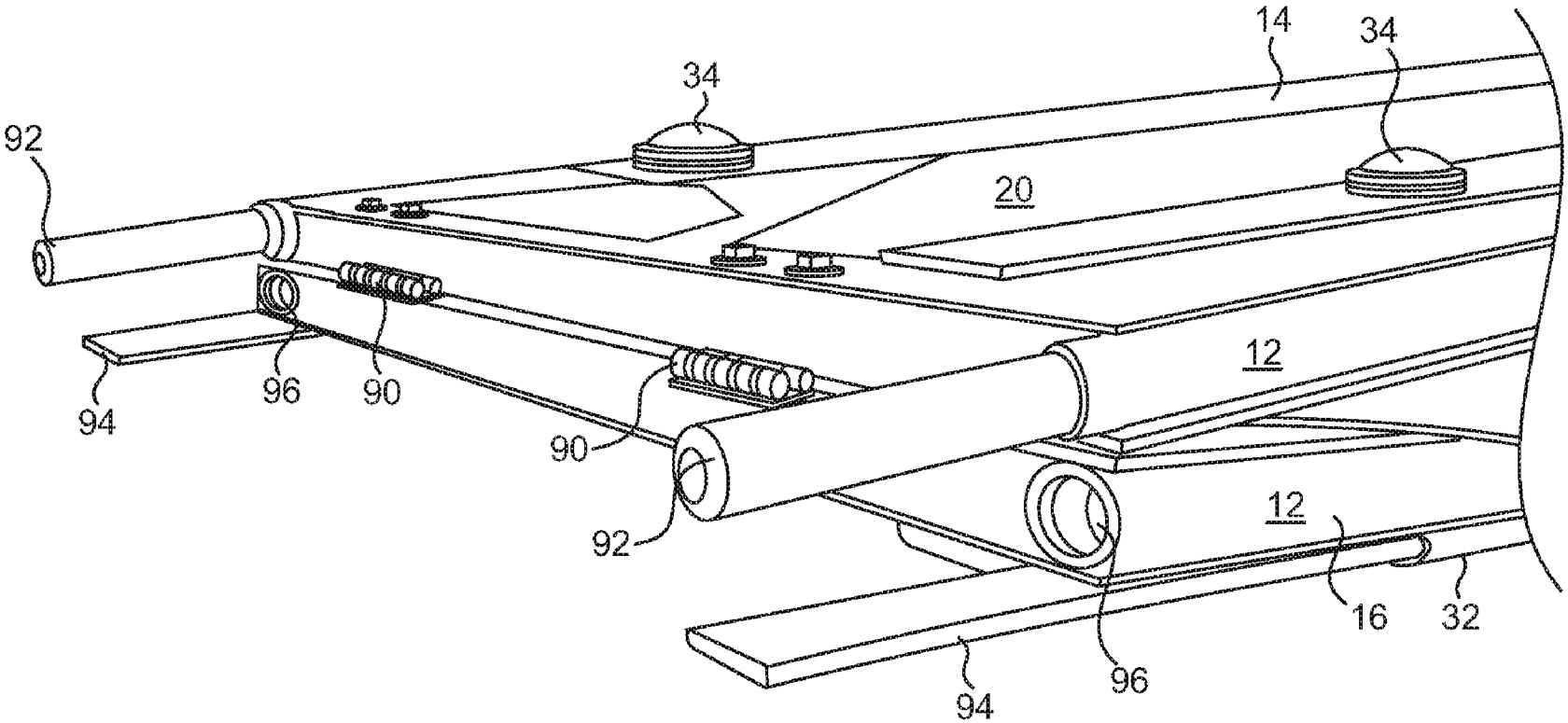
FIGS. 14-18 illustrates a size reduction mechanism on a stretcher.
Figure 15:
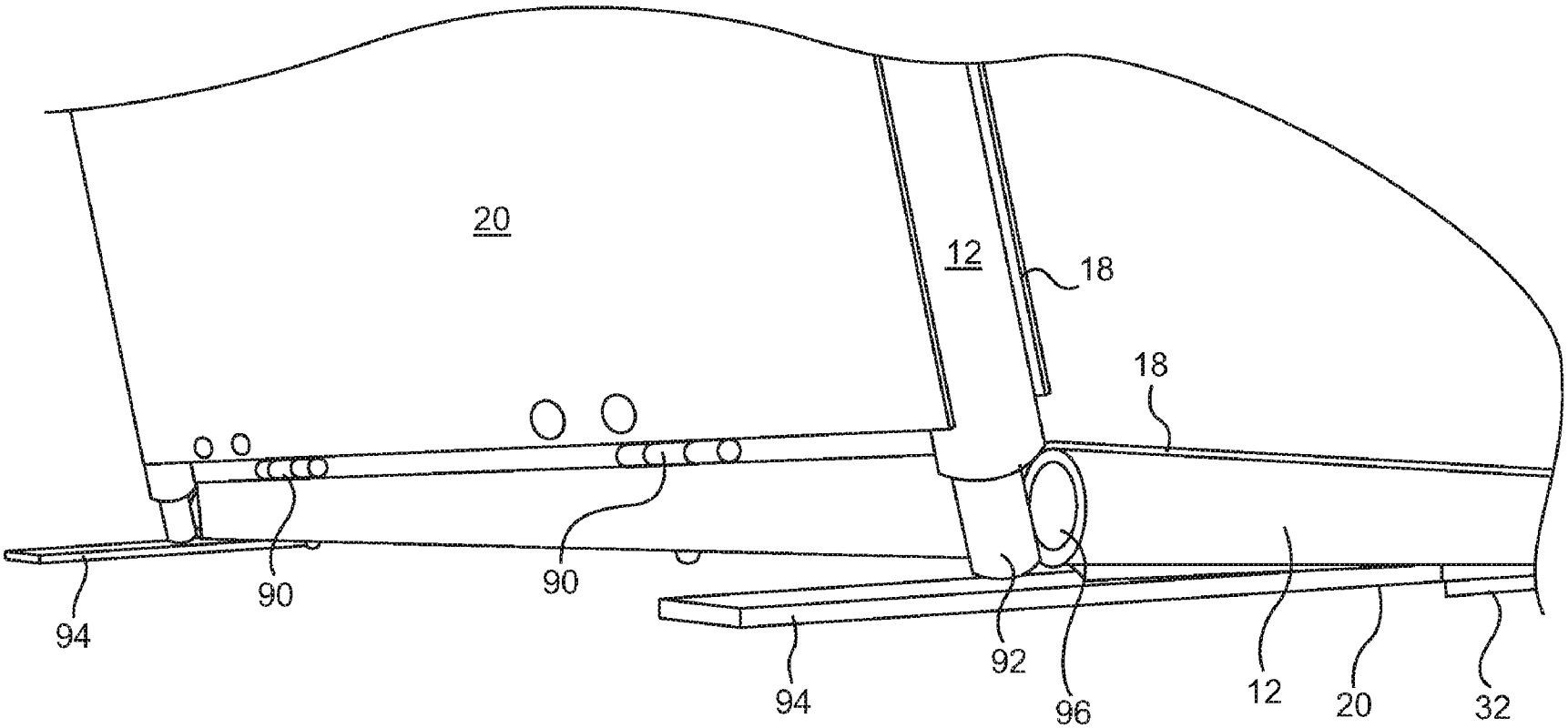
Figure 16:
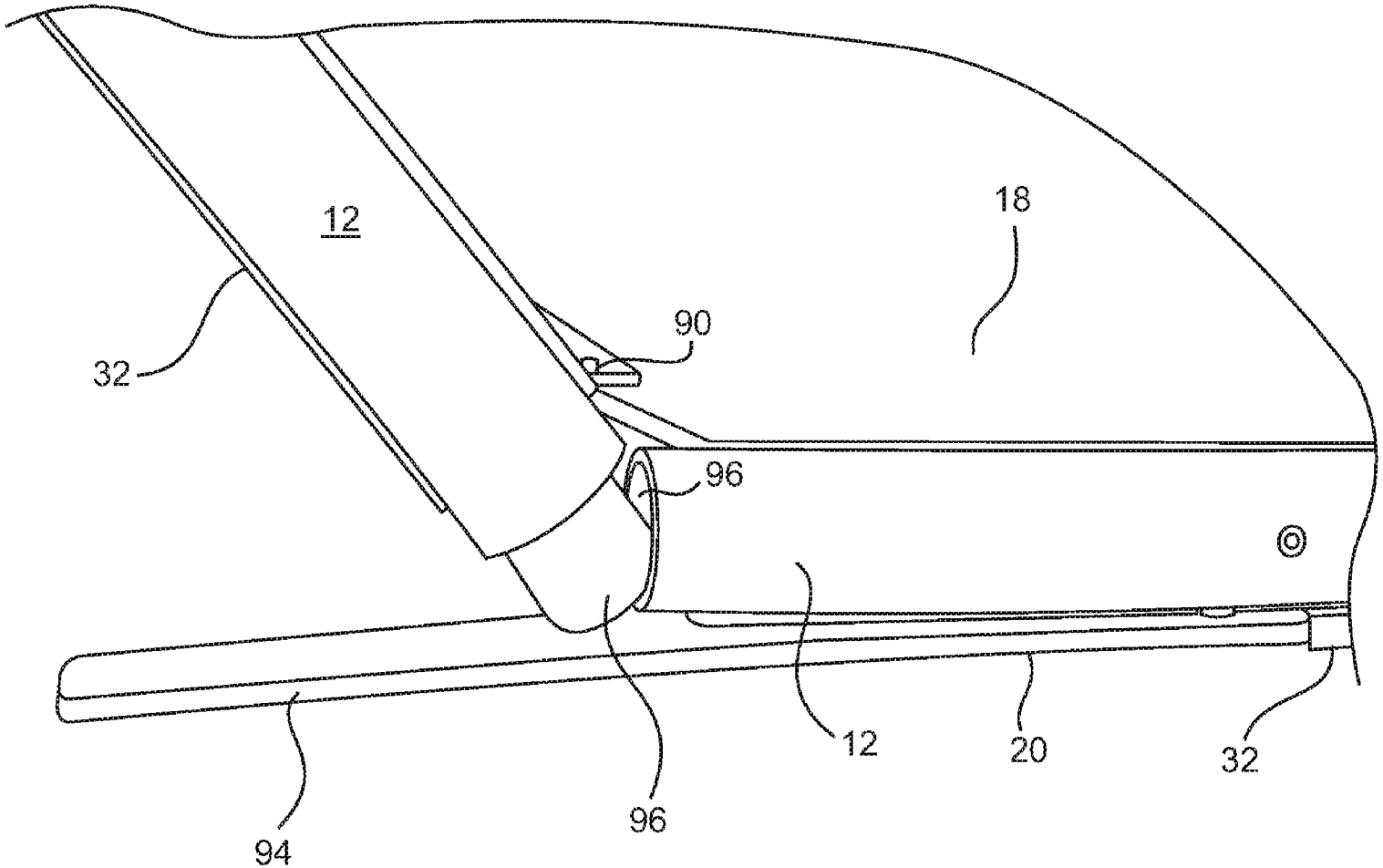
Figure 17:
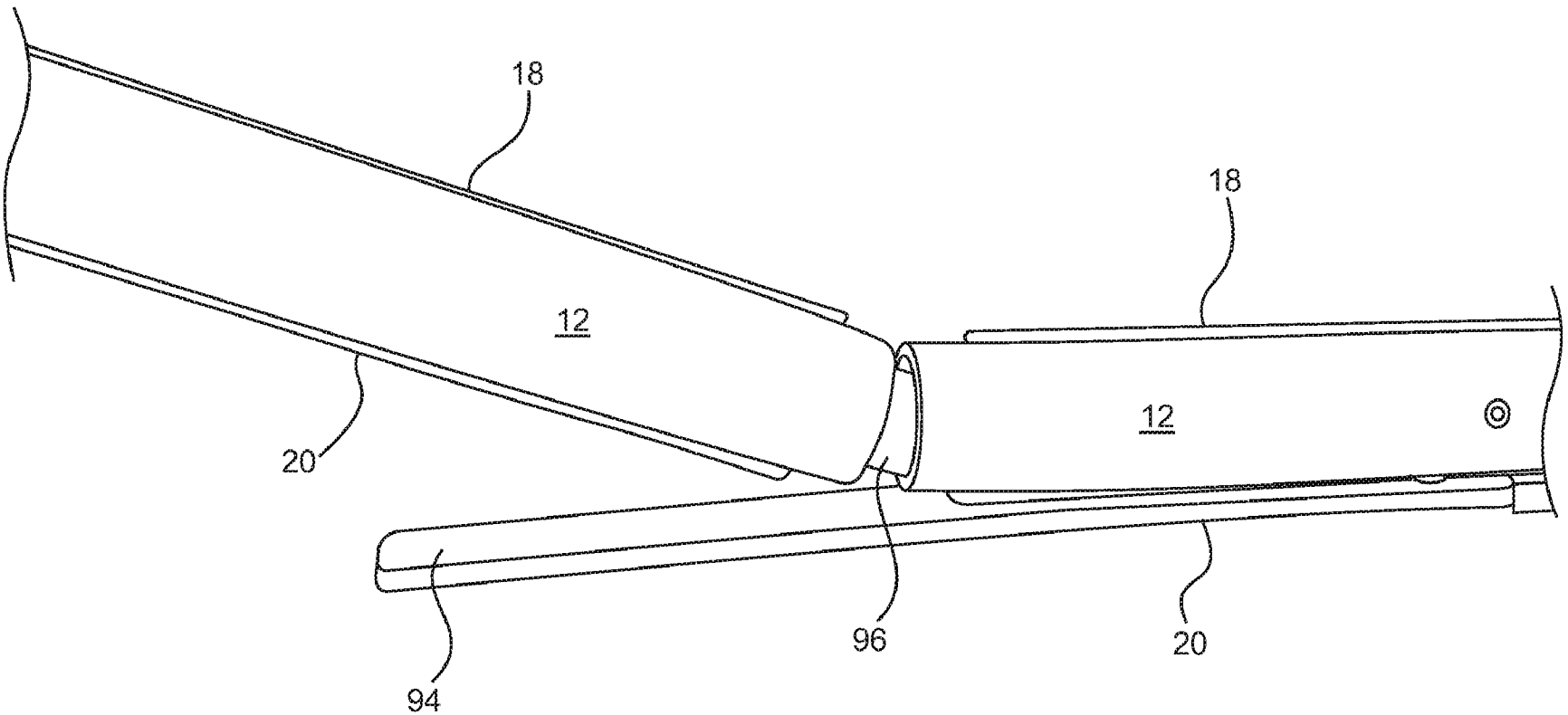
Figure 18:
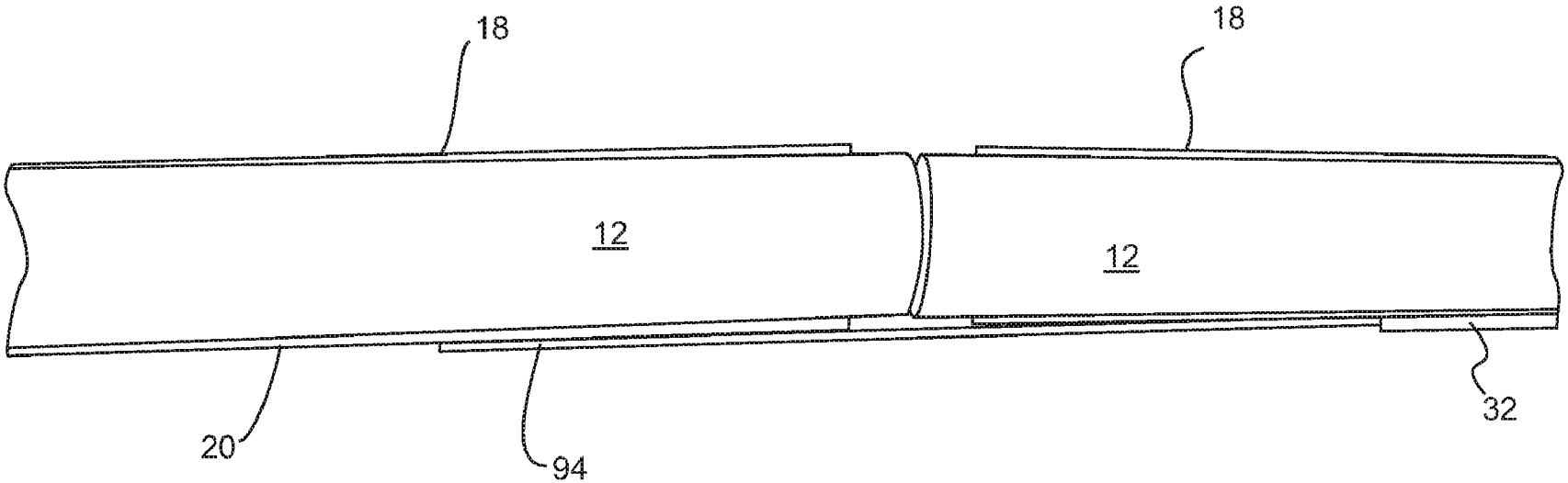

FIG. 11 is a magnified view of the brake mechanism 40. A connecting member 48 connects the support edge 38 with the attack edge 52 to give the friction portion 46 its semi-cylindrical shape. The connecting member 48 is preferably made of an extendable material to follow the shape of the friction portion 46 when acted upon by an external force.

Figure 2:
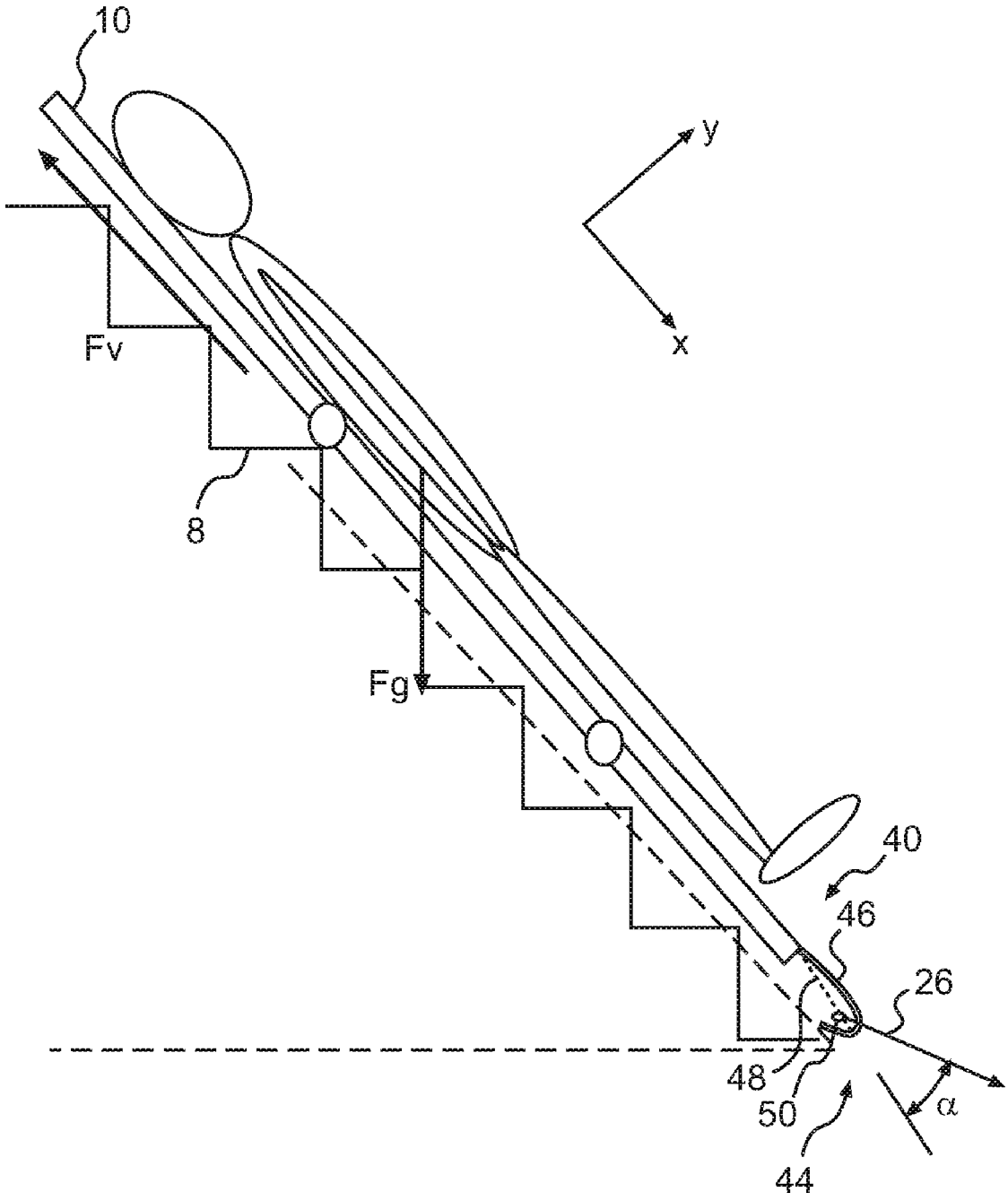
FIGS. 2-6 schematically illustrates variations in the brake mechanism position.
Figure 3:
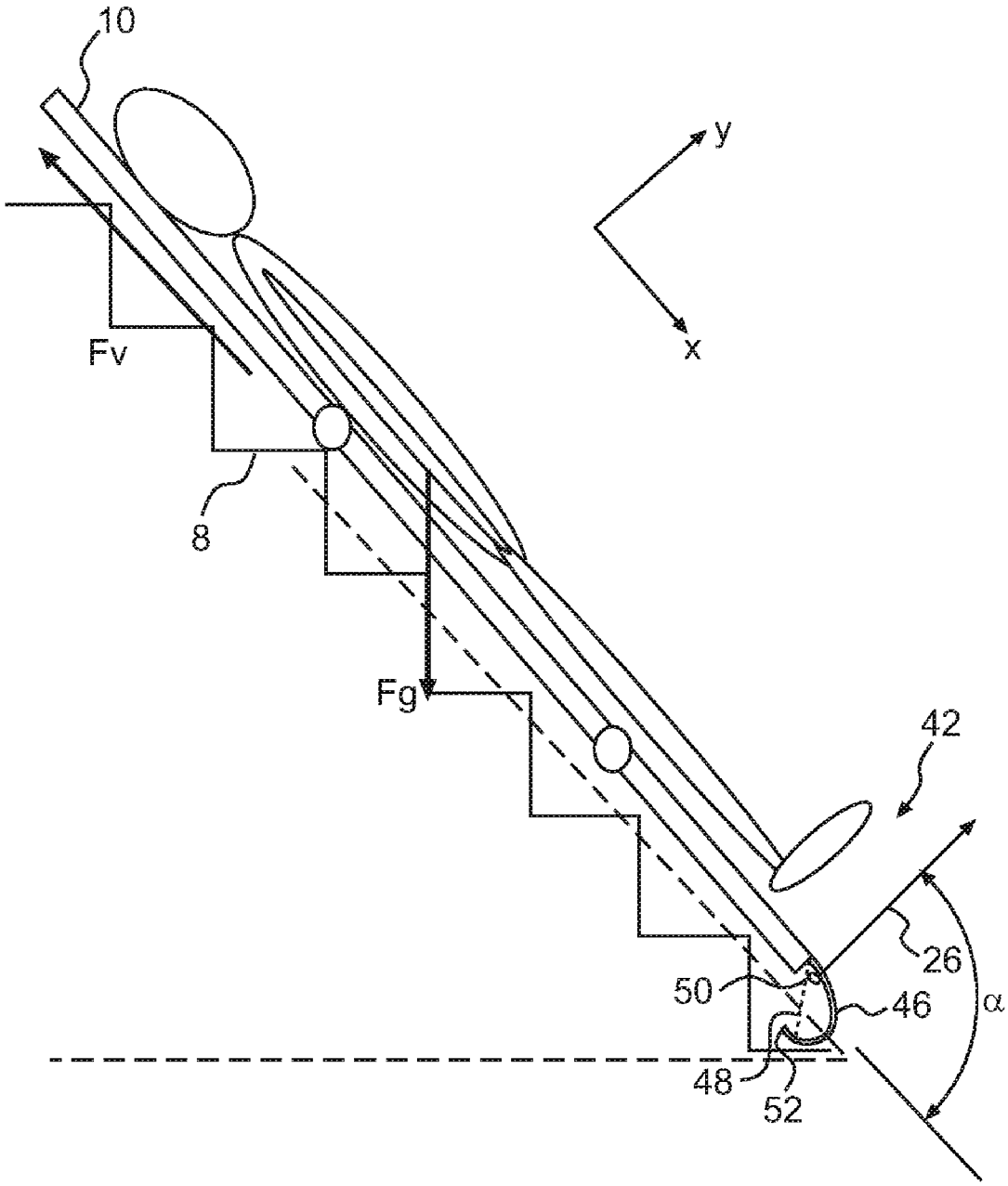
Figure 4:
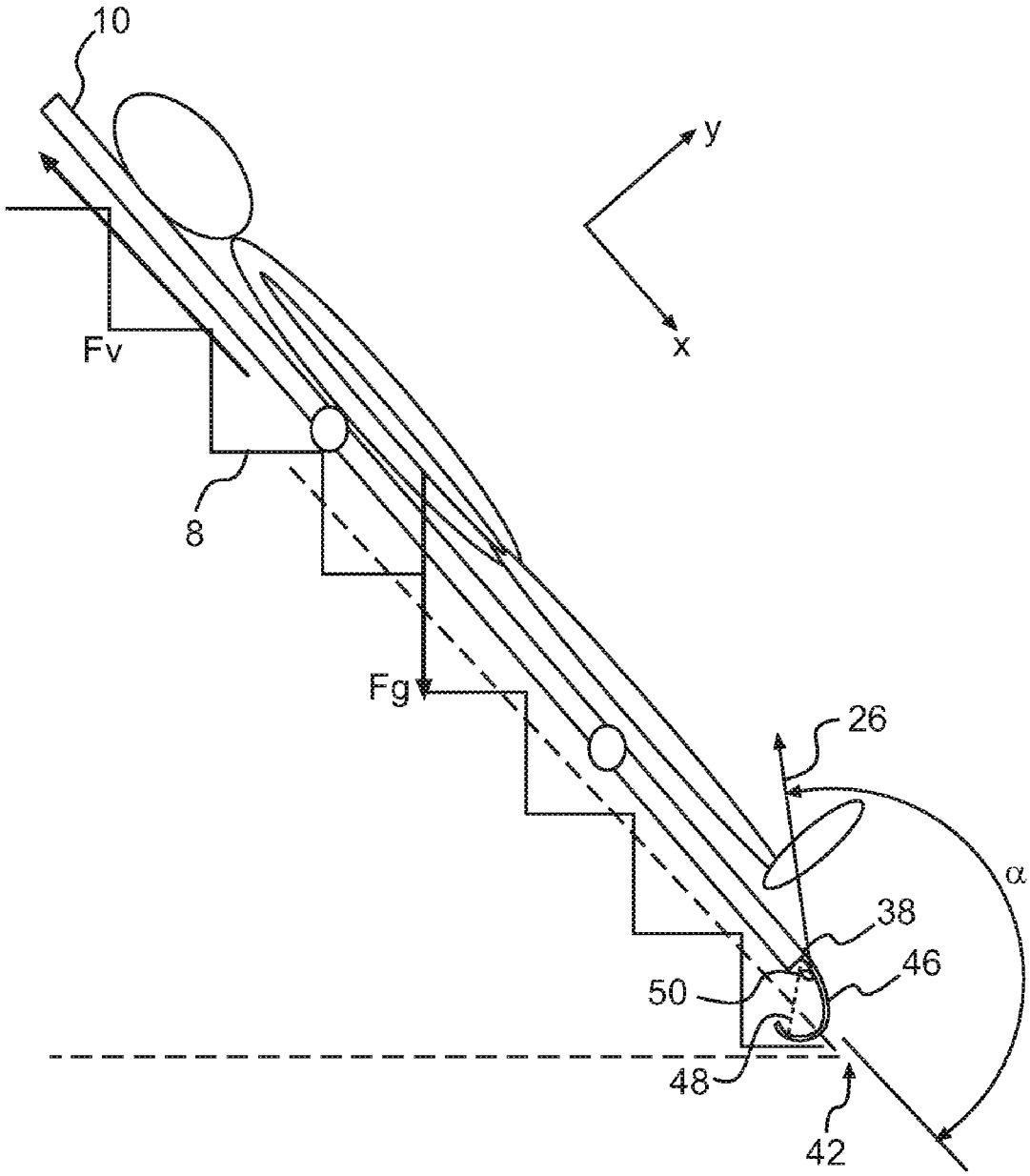

Still referring to FIG. 11, the pull member 26 includes a sliding member 50 interconnecting and moving along connecting members 48. The combined effects of the sliding members 50, the connecting members 48 and the pull members 26 is illustrated on FIGS. 2 through 6. More precisely, on FIG. 2, the pull member 26 is at an angle $\alpha$ with the stretcher 10 plane. When pulled at the illustrated angle $\alpha$, the sliding member 50 moves on one side of the connecting members 48 and maintains the brake mechanism in a brake mechanism released position 44. This is the position of the pull member 26 when the pull member 26 is used to pull the stretcher 10 and when any braking is undesirable. FIG. 3 depicts the pull member 26 at a different angle $\alpha$ where the pull member 26 slid along the opposite side of the connecting members 48. The brake mechanism is then in a brake mechanism engaged position 42 and is about to engage the stretcher 10 and the stairs 8 thus increasing friction and slowing down (or stopping) the movement of the stretcher 10. The angle $\alpha$ with the pull member 26 is reached if the stretcher 10 moves down too quickly and needs to be braked while coming closer to the person standing in front of the stretcher 10 and holding the pull member 26. The angle $\alpha$ also represents the position of the pull member 26 when held by a person holding the pull member 26 if the stretcher 10 moves too quickly toward the person. FIG. 4 is following the pull member 26 movement illustrated in FIG. 3. It will be noticed that the brake mechanism 40 remains in the brake mechanism engaged position 42 even if the angle $\alpha$ is more pronounced, since the sliding members 50 remain close to the support edge 38.

Figure 5:
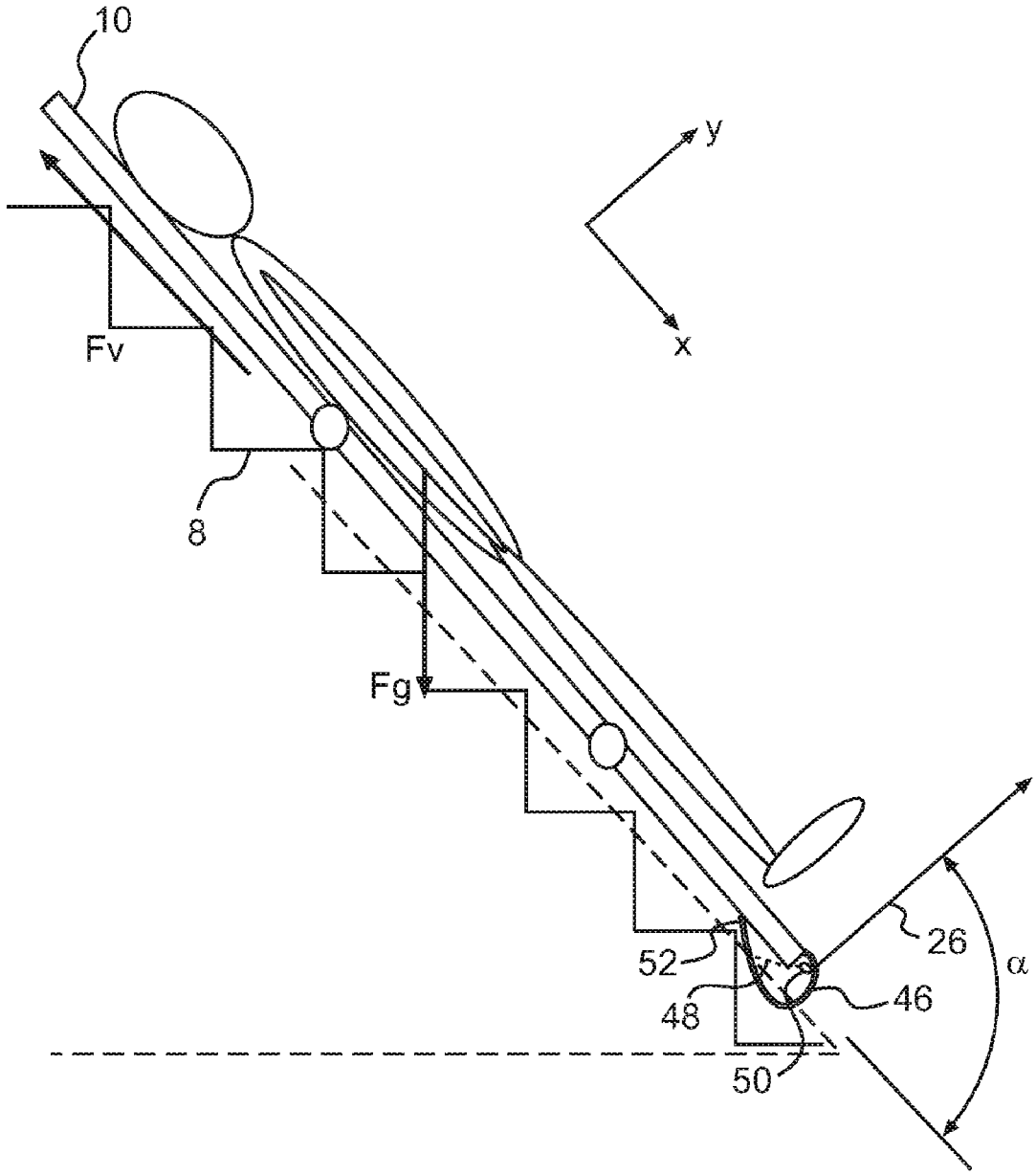
Figure 6:
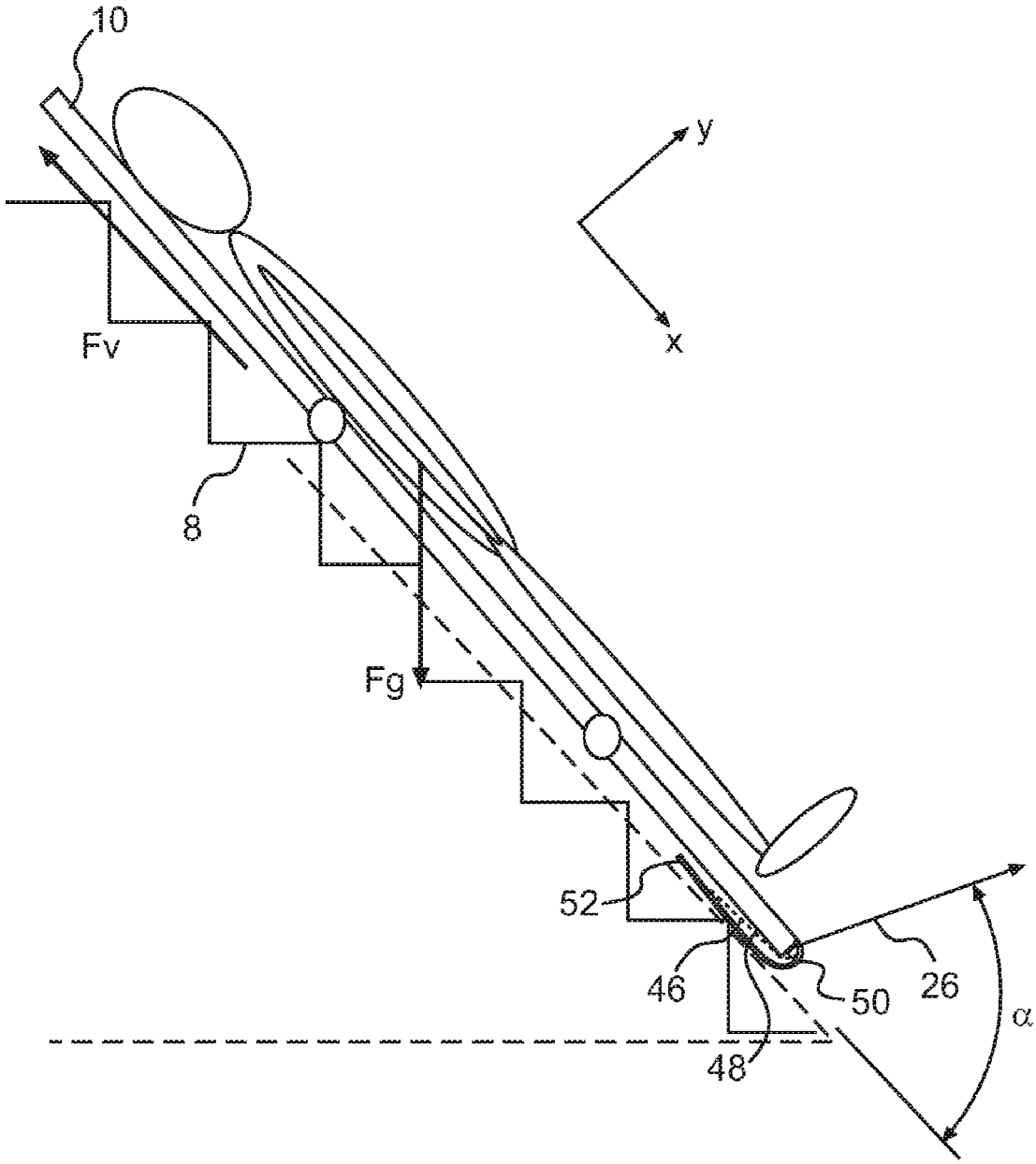
Figure 7:
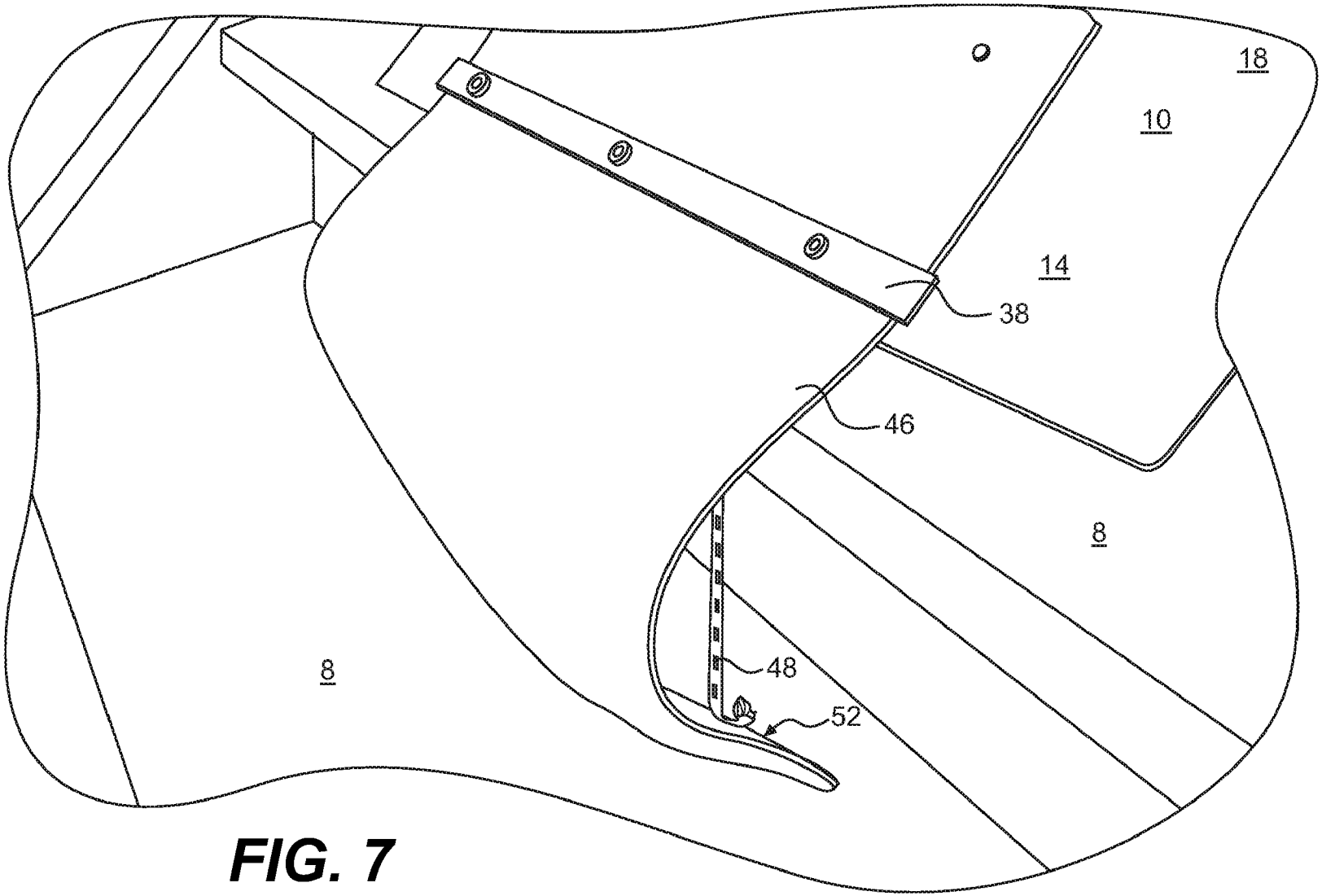
FIGS. 7-13 illustrates a brake mechanism on a stretcher.
Figure 8:
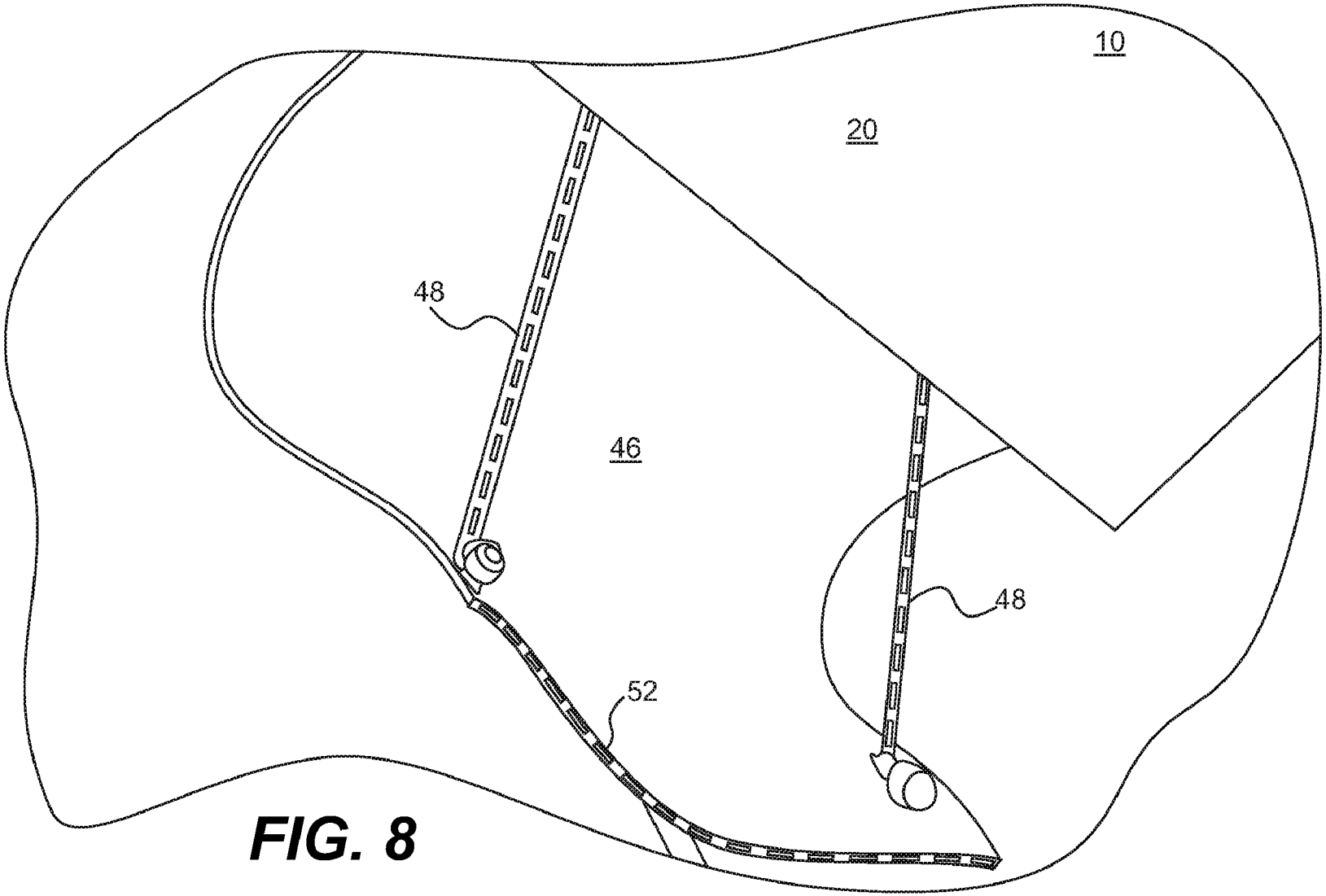
Figure 9:
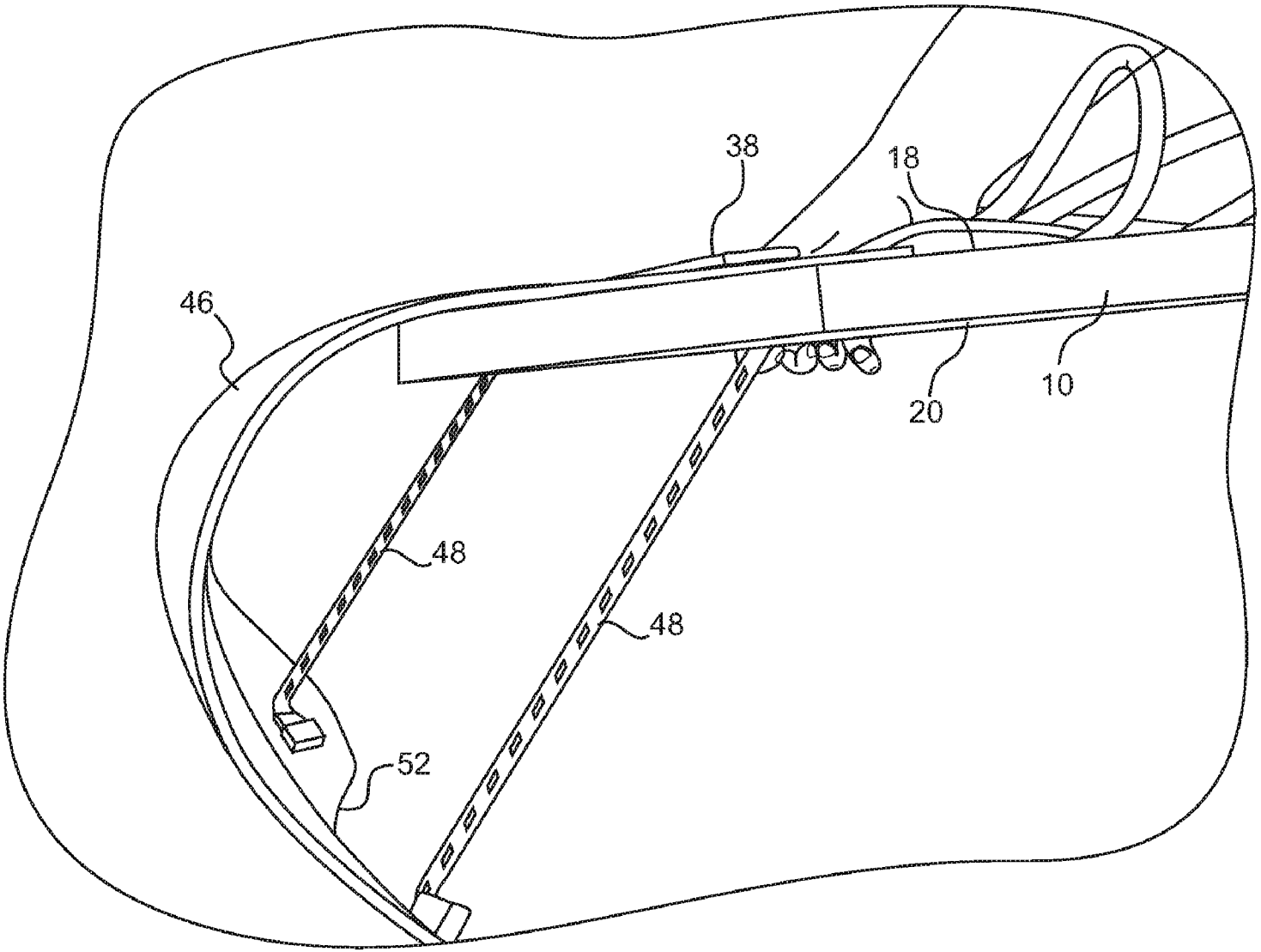
Figure 10:
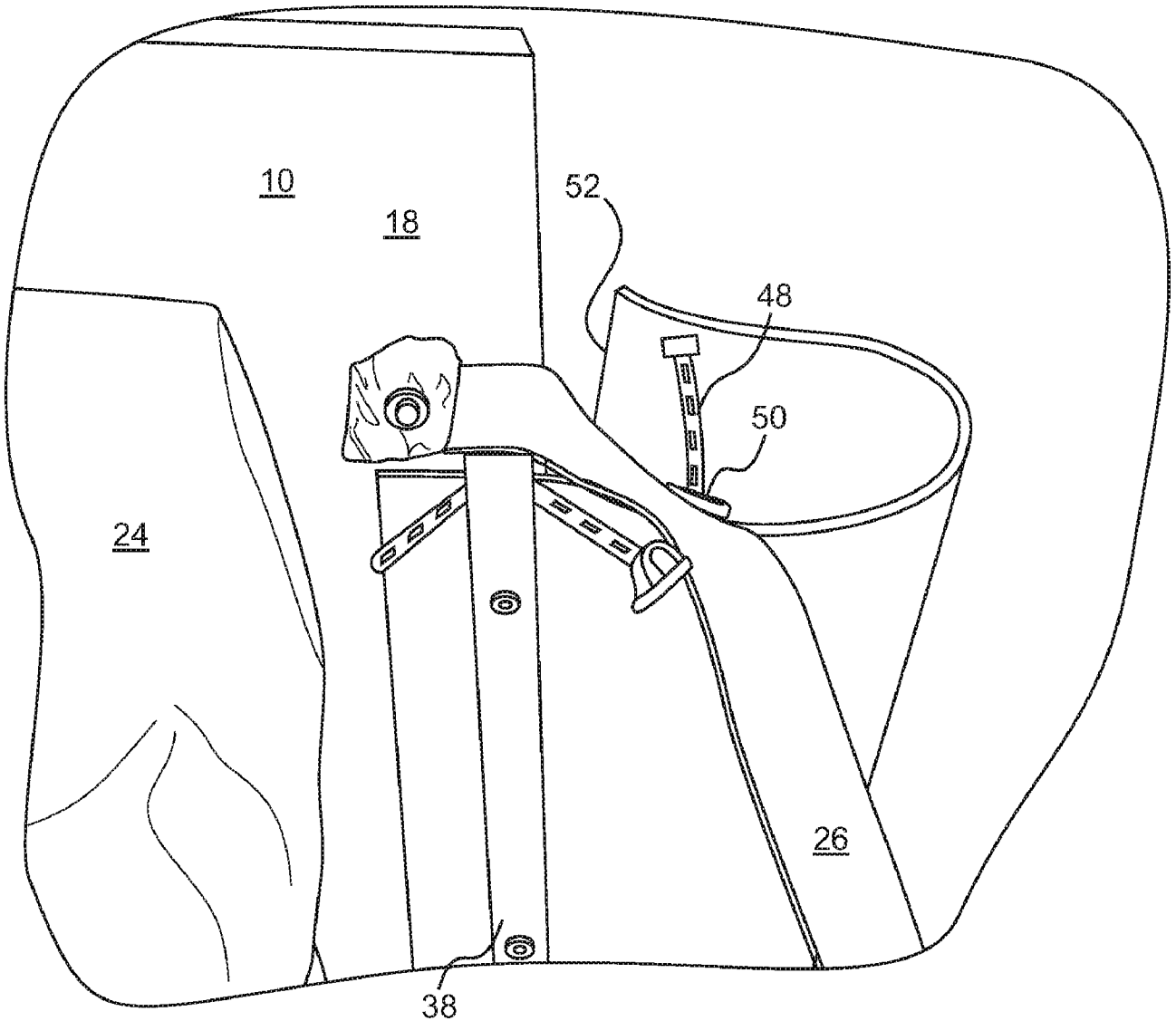

FIGS. 5 and 6 illustrates various pulling member 26 angles $\alpha$ when the friction portion 46 is trapped between the stairs 8 and the stretcher 10. Only a strong pull on the pull member 26 will move the sliding members 50 along the connecting members 48 close to the attack edge 52 and remove the friction portion 46 from under the stretcher 10 back to the brake mechanism released position 44.

FIGS. 14 through 18 illustrates a locking mechanism to secure two hinged 90 portions 14, 16 of the stretcher 10 in an operative position. The front portion 14 of the stretcher 10 is folded on the rear portion 16 to reduce the size of the stretcher when not in use. To bring back the stretcher 10 to its usable shape, the front portion 14 is moved perpendicular to the bottom portion 16. Spring loaded plungers 92 contact guide plates 94, move inwardly until they can extend back into the frame 12 respective openings 96.

To fold the stretcher 10 the plungers 92 are manually retracted in the frame with a pulling means (for instance steel wires running in the frame) until both frame 12 portions 14, 16 can move about hinge 90.

Figure 19:
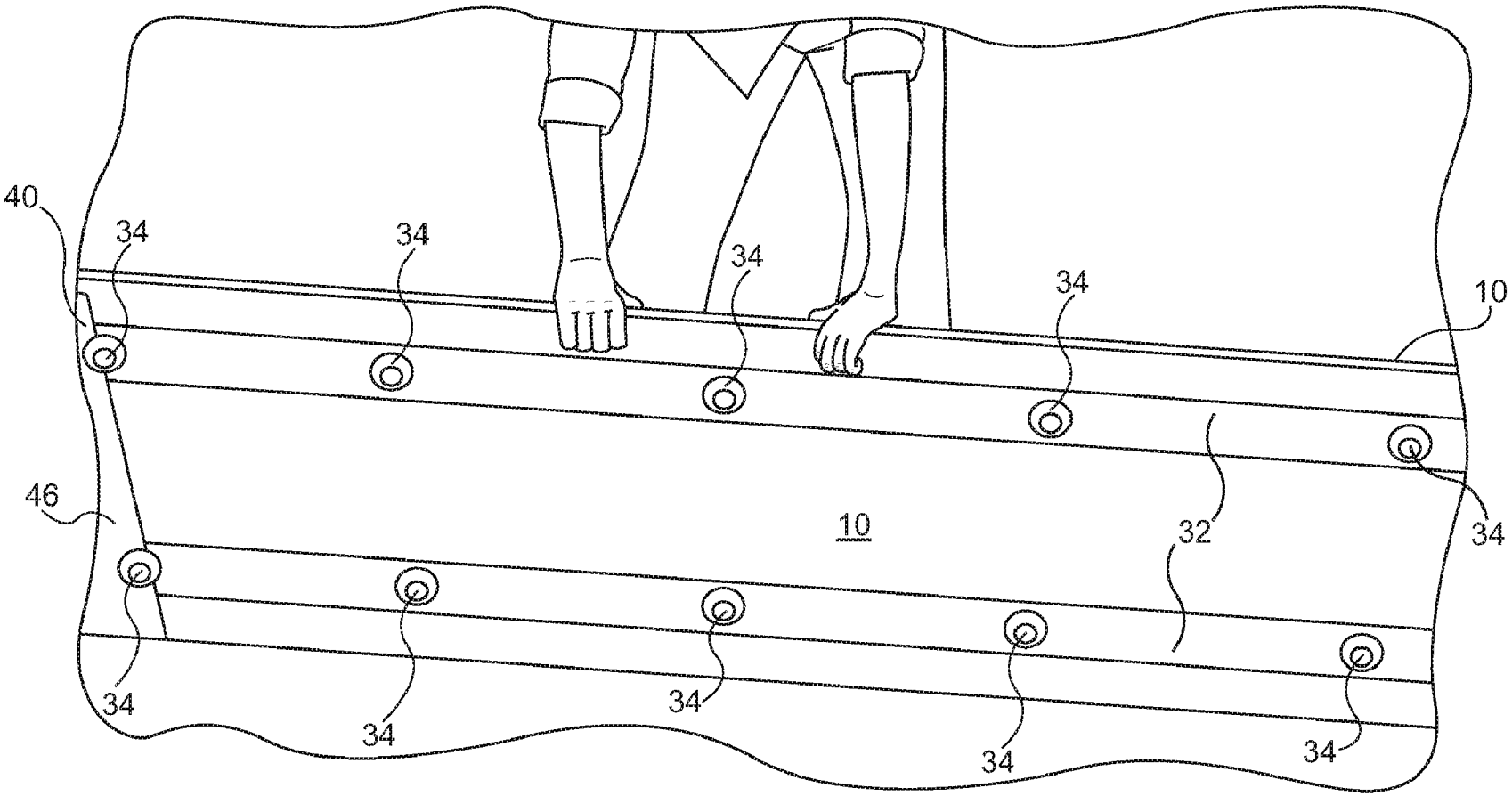
FIG. 19 illustrates various friction members under a stretcher.

FIG. 19 depicts high friction members 32 and low friction members 34 disposed underneath the stretcher 10. High friction members 32 preferably longitudinally cover two long strips under the stretcher 10 to ensure contact with portion of stairs 8 wherever the stairs contact the stretcher. Low friction members 34 are discretely disposed along the bottom side of the stretcher 10 and are sufficient in number to provide contact with level ground and prevent the high friction members 32 from touching the ground at the same time as the low friction members. The low friction members 34 are intended to reduce the force required to pull the stretcher on the ground. Conversely, the high friction members 32 reduce the speed of the stretcher 10 supported by stairs 8 when moving down a staircase.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A stretcher comprising:

a frame having a top side adapted to accommodate a person and a generally planar bottom side, opposite the top side and generally coextensive therewith, adapted to contact a staircase;

a restraint associated with the frame to secure a patient on the stretcher when the stretcher is used to transport the patient; and a brake associated with the frame to selectively increase friction between the stretcher and the staircase when the stretcher is moved along the staircase, the brake being moveable between a brake engaged position, and a brake released position, the stretcher further comprising a pull member, the pull member moveable to move the brake between the brake engaged position and the brake released position.

2. The stretcher of claim 1, further comprising a brake release.

3. The stretcher of claim 1, further comprising a high-friction member disposed on the bottom side of the frame to increase friction between the bottom side of the stretcher and the staircase.

4. The stretcher of claim 3, further comprising a low-friction member disposed on the bottom side of the frame to decrease friction between the bottom side of the stretcher and a ground.

5. The stretcher of claim 4, wherein the high-friction member and the low-friction member each have a ground contacting surface, the ground contacting surface of the high-friction member being disposed closer to the bottom side than the ground contacting surface of the low-friction member, whereby the stretcher is mostly supported by the low-friction member when on a flat ground.

6. The stretcher of claim 3, wherein the brake further comprises a friction portion adapted to contact the staircase when the brake is in the brake engaged position to further increase friction between the stretcher and the staircase, whereby the stretcher cannot move by itself when on an inclined plane.

7. The stretcher of claim 6, wherein the friction portion is disposed between the bottom side of the frame and the staircase when the brake is in the brake engaged position.

8. The stretcher of claim 6, wherein the friction portion is made of a rubber material.

9. The stretcher of claim 8, wherein the friction portion has a curved shape having two opposed end portions, a first end portion being affixed to the stretcher and the second end portion defining an attack edge.

10. The stretcher of claim 6, wherein the friction portion further comprises an attack edge adapted to contact the staircase and to position the friction portion such that the bottom side of the frame at least partially moves over the friction portion to increase friction between the bottom side and the staircase.

11. The stretcher of claim 6, wherein the frame is foldable.

12. The stretcher of claim 6, further including a foot restraint disposed on the top side of the frame to secure the feet of a patient when a patient is transported with the stretcher.

13. The stretcher of claim 6, further comprising a guiding means disposed on the stretcher.

14. The stretcher of claim 6, further comprising a head restraint disposed on the top side of the frame for securing the head of the patient.

15. The stretcher of claim 1, wherein the brake is in contact with the staircase when the brake is in the brake engaged position.

16. The stretcher of claim 1, wherein the brake is not in contact with the staircase when the brake is in the brake released position.

* * * * *